US010029866B2

(12) United States Patent
Harada

(10) Patent No.: US 10,029,866 B2
(45) Date of Patent: Jul. 24, 2018

(54) IMAGE FORMING APPARATUS

(71) Applicant: KYOCERA Document Solutions Inc., Osaka (JP)

(72) Inventor: Kaori Harada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/528,520

(22) PCT Filed: Feb. 10, 2016

(86) PCT No.: PCT/JP2016/053909
§ 371 (c)(1),
(2) Date: May 22, 2017

(87) PCT Pub. No.: WO2016/158021
PCT Pub. Date: Oct. 6, 2016

(65) Prior Publication Data

US 2017/0267471 A1 Sep. 21, 2017

(30) Foreign Application Priority Data

Mar. 27, 2015 (JP) ..... 2015-066177

(51) Int. Cl.

| | |
|---|---|
| ***B65H 3/06*** | (2006.01) |
| ***B65H 1/14*** | (2006.01) |
| ***B65H 1/26*** | (2006.01) |
| ***B65H 7/02*** | (2006.01) |

(52) U.S. Cl.
CPC ..... *B65H 3/0661* (2013.01); *B65H 1/14* (2013.01); *B65H 1/26* (2013.01); *B65H 7/02* (2013.01)

(58) Field of Classification Search
CPC ... B65H 1/14; B65H 3/06; B65H 7/20; B65H 2405/1117; B65H 2405/35; B65H 2405/351; B65H 2405/353; B65H 2405/354; B65H 2511/152; B65H 2515/708; B65H 2553/21
See application file for complete search history.

(56) References Cited

U.S. PATENT DOCUMENTS 8,382,097 B2 * 2/2013 Chiba ..... B65H 1/14 271/147

FOREIGN PATENT DOCUMENTS

JP 10274869 A * 10/1998
JP 11167236 A * 6/1999
JP 2007210763 A * 8/2007
(Continued)

*Primary Examiner* — David H Bollinger
(74) *Attorney, Agent, or Firm* — Studebaker & Brackett PC

(57) ABSTRACT

A sheet feeding device (4) includes a placing plate (34) on which a sheet is placed; a pickup roller (71) which feeds the sheet to a conveying path (25); a lift member (36) which is turned around a rotating shaft (46) to elevate the placing plate (34) and to make an downstream side end portion of an uppermost sheet in a conveying direction come into contact with the pickup roller (71); a drive unit (37) which rotates the rotating shaft (46); a variable resistor (54) which changes an electric resistance value depending on a rotating angle of the rotating shaft (46); and a control part (77) which calculates the rotating angle of the rotating shaft (46) using the electric resistance value measured by the variable resistor (54) and detects an amount of the sheets based on the calculated rotating angle.

7 Claims, 6 Drawing Sheets

(56) References Cited

FOREIGN PATENT DOCUMENTS

| | | | | | |
|---|---|---|---|---|---|
| JP | 2008-133060 | A | | 6/2008 | |
| JP | 2012121685 | A | * | 6/2012 | ..... B65H 1/14 |

* cited by examiner

IMAGE FORMING APPARATUS

TECHNICAL FIELD

The present invention relates to a sheet feeding device which feed a sheet to be formed with an image and an image forming apparatus including the sheet feeding device.

BACKGROUND

In an image forming apparatus, such as a printer and a copying machine, a sheet to be formed with an image is conveyed to an image forming part from a sheet feeding device. In the sheet feeding device, a pickup roller comes into contact with a downstream side end portion in a conveying direction of the sheet stored in a sheet feeding cassette, and then rotates to feed the uppermost sheet to the image forming part. In order to keep a feeding position where the pickup roller comes into contact with the uppermost sheet constant, an elevating plate on which the sheet is placed is supported so as to be inclined by a lift member. The lift member is turned around a rotating shaft by a drive unit to incline the elevating plate.

In addition, the sheet feeding device is sometimes configured to detect an amount of sheet placed on the elevating plate and then inform a user of a replenishment of sheets if necessary. In the above described sheet feeding device configured to incline the elevating plate, an inclining angle of the elevating plate, that is, an inclining angle of the lift plate is changed depending on the amount of sheets placed on the elevating plate. Based on the fact, a mechanism which detects a remaining amount of sheets by using the rotating angle of the rotating shaft of the lift member has been known. The mechanism for detecting a remaining amount of sheets will be described with reference to FIG. 6.

As shown in FIG. 6, the rotating shaft 101 of the lift member 100 is driven by the drive unit 102. The drive unit 102 includes a motor 103 and an output shaft 104 coupled to a motor shaft 103*a* of the motor 103 via gears. The rotating shaft 101 of the lift member 100 is coupled to an output shaft of the drive unit 102 by a joint member 105 so that they are integrally rotatable. To the rotating shaft 101 of the lift member 100, an actuator 107 having an approximately fan-like shape, as viewed from an axis direction of the rotating shaft 101, is provided so that they are integrally rotatable. In addition, within a rotation locus of the actuator 107 which is turned as the rotating shaft 101 is rotated, two sensors 108 and 109 which detect the actuator 107 are arranged at a predetermined interval at an upstream side and a downstream side. By turning the two sensors 108 and 109 into ON or OFF due to the rotating of the actuator 107, a rotating angle of the rotating shaft is detected at a plurality of steps (for example, three steps).

In the Patent Document 1, an example of the sheet feeding device is disclosed. The sheet feeding device includes an indicating piece coupled to the gear provided to the rotating shaft of the lift member via gears. As the rotating shaft is rotated, a position of the indicating piece is changed to inform a user of a remaining amount of sheets.

PRIOR ART DOCUMENT

Patent Document

[Patent Document 1] Japanese Patent laid-open Publication No. 2008-133060

SUMMARY OF INVENTION

Problems to be Solved by the Invention

However, in the mechanism for detecting a remaining amount of sheets by using the actuator and the two sensors as shown in FIG. 6, the mechanism may become large in size and the number of the parts may be increased. In addition, because the remaining amount of sheets is roughly detected, it is difficult to inform a user of the remaining amount of sheets in more detail. In the sheet feeding device of the Patent Document 1, because the indicating piece is provided on a side face of the sheet feeding cassette, the user hardly recognizes a remaining amount of sheets.

The present invention has been made in view of the circumstance described above, and it is an object of the present invention to provide a sheet feeding device capable of detecting a remaining amount of sheets at multiple steps and having a simple structure and an image forming apparatus including the sheet feeding device.

Means of Solving the Problems

An image forming apparatus according to the present invention includes a placing plate on which a sheet is placed; a pickup roller which feeds the sheet to a conveying path; a lift member which is turned around a rotating shaft to elevate the placing plate and to make an downstream side end portion of an uppermost sheet in a conveying direction come into contact with the pickup roller; a drive unit which rotates the rotating shaft; a variable resistor which changes an electric resistance value depending on a rotating angle of the rotating shaft; and a control part which calculates the rotating angle of the rotating shaft using the electric resistance value measured by the variable resistor and detects an amount of the sheets based on the calculated rotating angle.

Effects of the Invention

According to the present invention, a remaining amount of sheets stored in a sheet feeding cassette can be detected at finer steps by a small and simple structure.

THE MODE FOR CARRYING OUT THE INVENTION

Hereinafter, with reference to figures, an image forming apparatus according to an embodiment of the present disclosure will be described.

Figure 1:
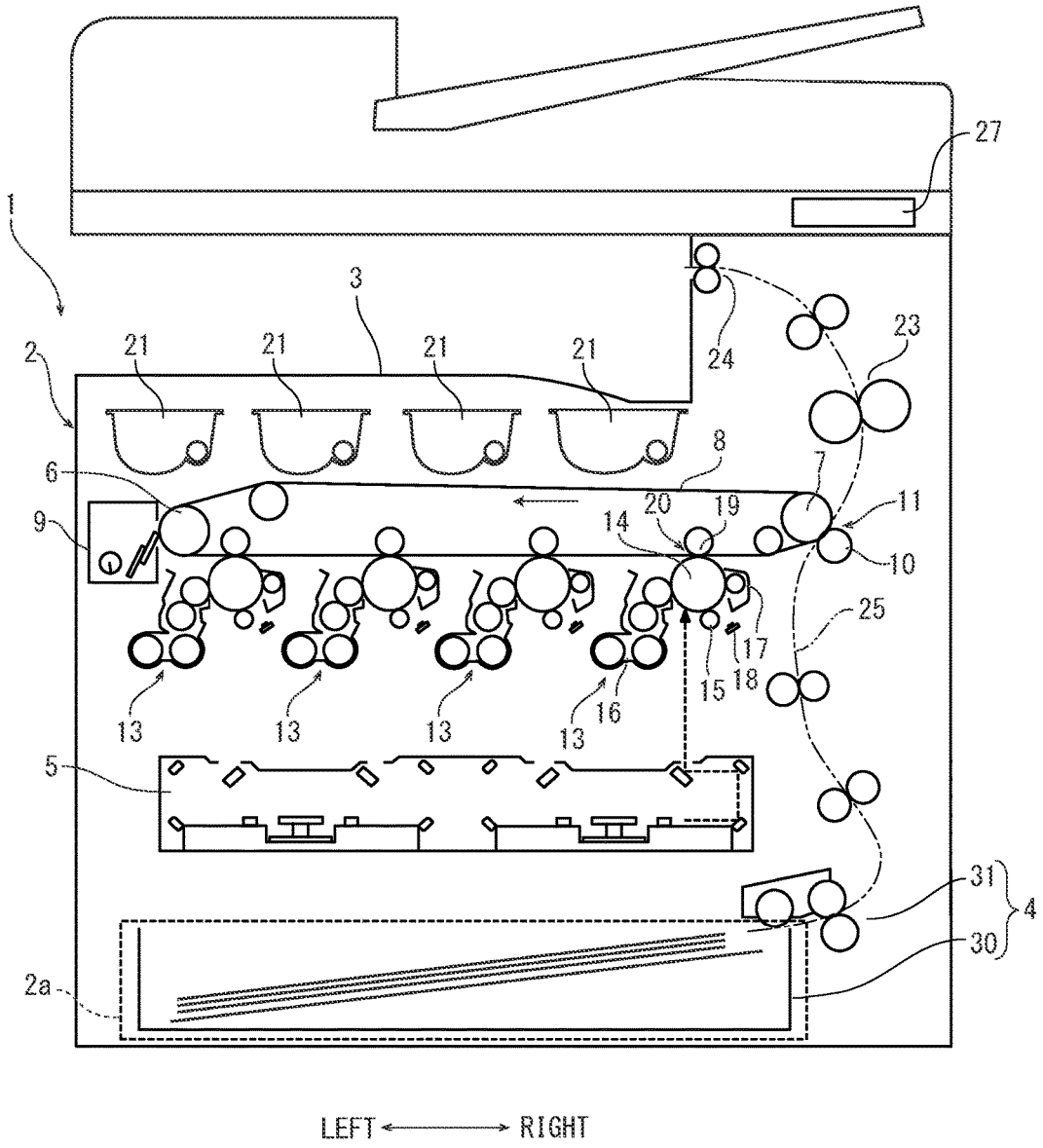
FIG. 1 is a view schematically showing a color printer according to an embodiment of the present invention.

With reference to FIG. 1, an entire structure of a color printer 1 (an image forming apparatus) will be described. FIG. 1 is a sectional view schematically showing an inner structure of the color printer 1 of the present embodiment. In the following description, a near side of a paper plan of FIG. 1 is set as a front side of the color printer, and left and right directions are based on a direction in which the color printer is seen from the front side.

The color printer 1 includes a box-shaped printer main body 2. On an upper face of the printer main body 2, an ejection tray 3 on which a sheet is ejected is formed. On a lower portion of a front face of the color printer 1, an opening 2*a* is formed. Inside the opening 2*a*, a sheet feeding device 4 configured to feed the sheet is provided. Above the sheet feeding device 4, an exposing device 5 having a laser scanning unit (LSU) is provided.

Above the exposing device 5, an intermediate transferring belt 8 is supported between a drive roller 6 and a driven roller 7 via tension rollers. A cleaning device 9 is disposed facing the drive roller 6 via the intermediate transferring belt 8. A second transferring roller 10 is disposed facing the driven roller 7 via the intermediate transferring belt 8 to form a second transferring part 11.

Along a lower portion of the intermediate transferring belt 8, four image forming parts 13 are arranged. In each image forming part 13, a photosensitive drum 14 is rotatably provided. Each image forming part 13 includes a charging device 15, a development device 16, a cleaning device 17 and a static eliminating device 18 which are arranged around the photosensitive drum 14 in the order of a first transferring process. Between the development device 16 and the cleaning device 17, a first transferring roller 19 is disposed via the intermediate transferring belt 8 to form a first transferring part 20. Above each development device 16, four toner containers 21 corresponding to the image forming parts 13 are provided for each color (Y, M, C and K) of the toner.

Inside the printer main body 2*a*, a fixing device 23 is provided above the second transferring part 11. Above the fixing device 23, a sheet ejection part 24 is provided. In addition, inside the printer main body 2*a*, a sheet conveying path 25 is formed so as to extend from the sheet feeding device 4 to the sheet ejection part 24 through the second transferring part 11 and the fixing device 23. On an upper portion of the printer main body 2*a*, an operation panel 27 is provided. Through the operation panel 27, various operations are input and an error information or the like are displayed.

Next, an operation of forming an image by the color printer 1 having such a configuration will be described. A surface of the photosensitive drum 14 is electrically charged by the charging device 15 and then exposed with a laser light (refer to an arrow) by the exposing device 5 to form an electrostatic latent image corresponding to an image data on the surface of the photosensitive drum 14. The electrostatic latent image is developed into a toner image of corresponding color by the development device 16. The toner image is first-transferred to a surface of the intermediate transferring belt 8 at the first transferring part 20. The above operation is carried out by every image forming unit 13 to form a full color toner image on the intermediate transferring belt 8. The toner remained on the photosensitive drum 14 is removed by the cleaning device 17 and the residual charge of the photosensitive drum 14 is eliminated by the static eliminating device 18.

On the other hand, the sheet fed from the sheet feeding device 4 is conveyed to the second transferring part 11 along the sheet conveying path 25 synchronously with the above-mentioned image forming process, and the full color toner image on the intermediate transferring belt 8 is second-transferred on the sheet at the second transferring part 11. The sheet on which the toner image is second-transferred is conveyed downward along the sheet conveying path 25 to enter the fixing device 23. At the fixing device 23, the toner image is fixed on the sheet. The sheet with the fixed toner image is ejected on the ejection tray 3 by the sheet ejection part 24. The toner remained on the intermediate transferring belt 8 is cleaned by the cleaning device 9.

Figure 2:
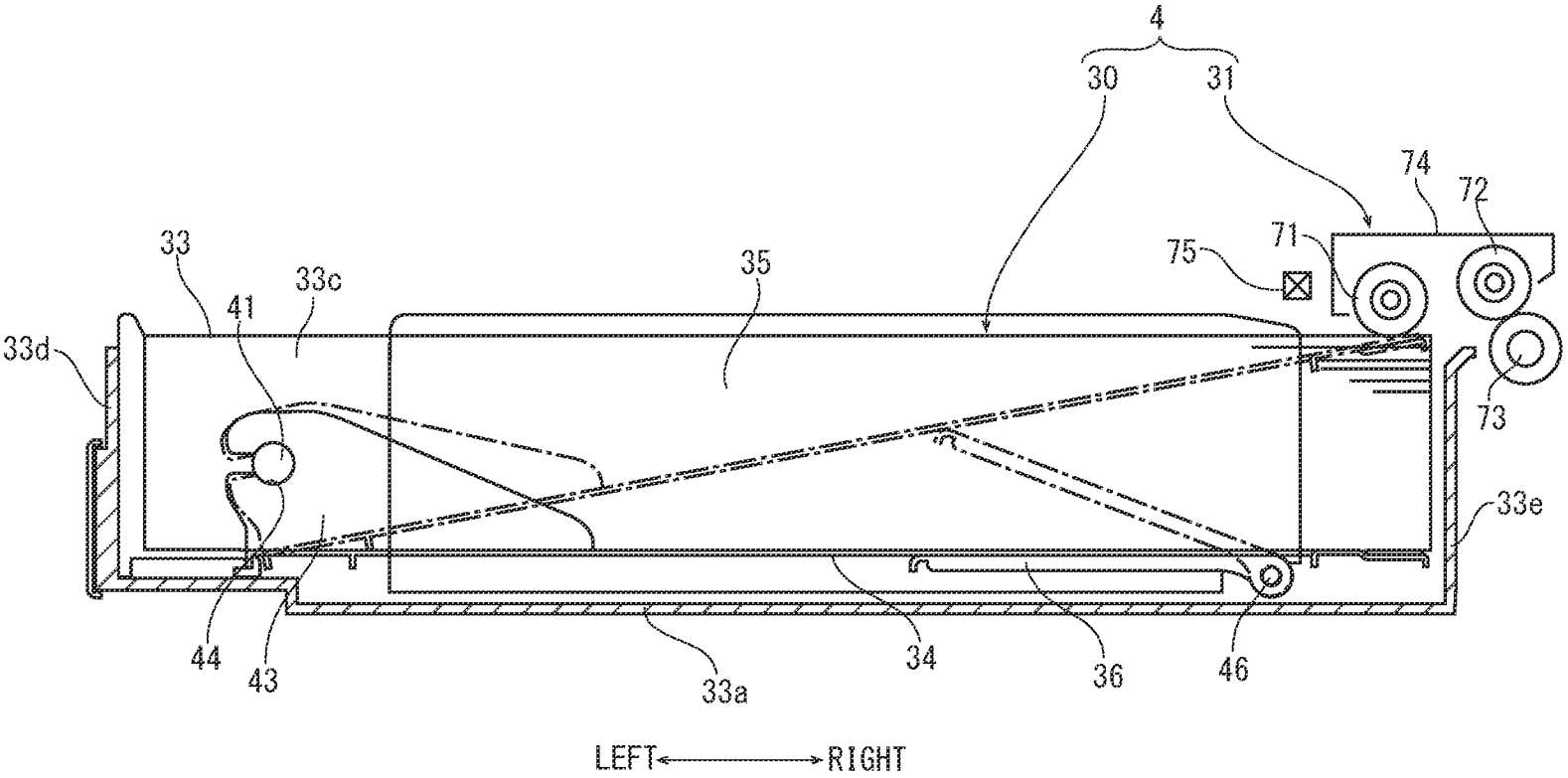
FIG. 2 is a side view showing a sheet feeding device according to the embodiment of the present invention.
Figure 4:
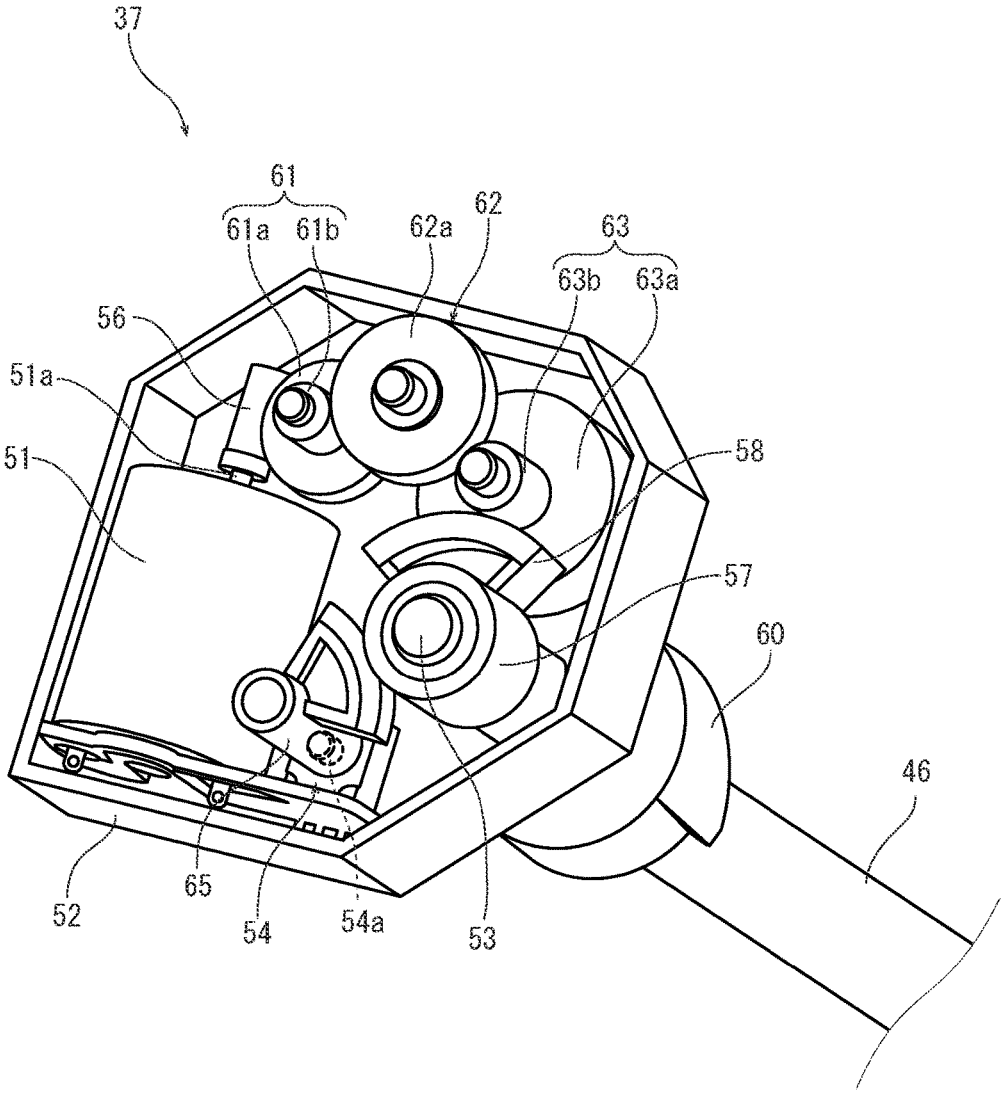
FIG. 4 is a perspective view showing a drive unit in the sheet feeding device according to the embodiment of the present invention.
Figure 5:
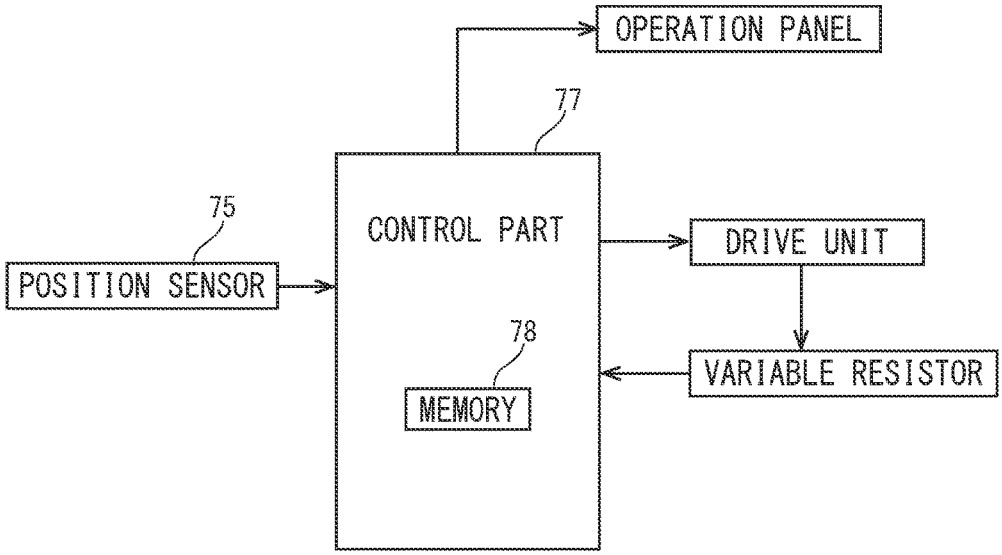
FIG. 5 is a block diagram showing a control part which detects a remaining amount of sheets, in the sheet feeding device according to the embodiment of the present invention.

Next, with reference to FIG. 2 to FIG. 5, the sheet feeding device 4 will be described. FIG. 2 is a side view showing the sheet feeding device, FIG. 4 is a perspective view showing a drive unit and FIG. 5 is a block diagram showing the sheet feeding device. The sheet feeding device 4 includes a sheet feeding cassette 30 in which the stacked sheets are stored and a sheet feeding mechanism 31 which feeds the sheet from the sheet feeding cassette 30.

Figure 3:
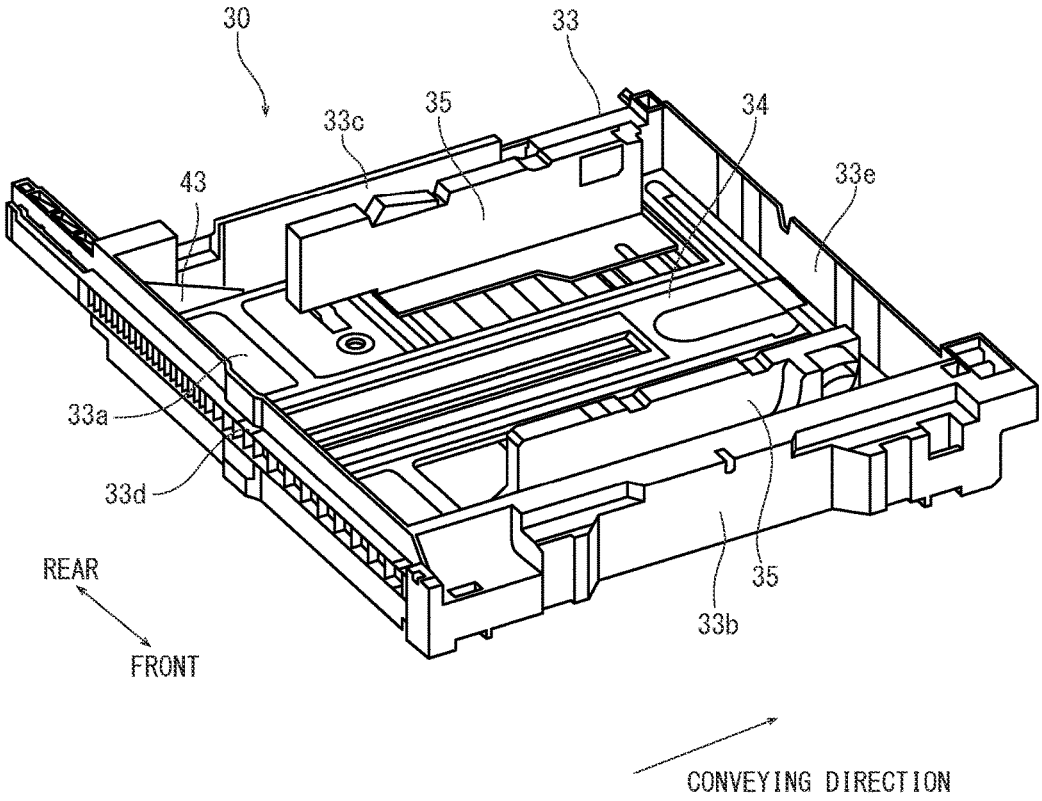
FIG. 3 is a perspective view showing a sheet feeding cassette in the sheet feeding device according to the embodiment of the present invention.

As shown in FIG. 2 and FIG. 3, the sheet feeding cassette 30 includes a main body part 33 in which the sheets are stored, a placing plate 34 on which the sheets are placed in the main body part 33, a pair of side cursors 35 supported so as to be slidable in a width direction perpendicular to the sheet conveying direction, a lift member 36 disposed under the placing plate 34 and a drive unit 37 which drives the lift member 36.

The main body part 33 is formed into a shallow box-like shape of which an upper face is opened, and has a bottom plate 33*a*, front and rear side plates 33*b* and 33*c*, and left and right side plates 33*d* and 33*e*. On inner faces of the front and rear side plates 33*b* and 33*c*, pins 41 are coaxially provided at downstream side end portions in the sheet conveying direction.

The placing plate 34 is a flat plate-shaped member. The placing plate 34 has slits formed along the width direction on both sides of the center in the width direction at the downstream side portion in the conveying direction. The placing plate 34 has vertical supporting pieces 43 connected along the upstream side portions of the front and rear edges. Each supporting piece 43 has an engagement part 44 capable of engaging with the pin 41 provided in each of the front and rear side plates 33*b* and 33*c*. By engaging each engagement part 44 with each pin 41, the placing plate 34 is supported so as to be rotatable in the counterclockwise direction in FIG. 2 around the pins 41.

The side cursors 35 are supported by the bottom plate 33*a* so as to be slidable in approaching and separating directions through the slits formed in the placing plate 34. The side cursors 35 are brought into contact with side edges of the sheet in the width direction to adjust the position of the sheet in the width direction.

The lift member 36 is disposed between an upper face of the bottom plate 33*a* and a lower face of the downstream side end portion of the placing plate 34, as shown in FIG. 2. Along the downstream side edge of the lift member 36, a rotating shaft 46 is provided. The rotating shaft 46 penetrates through the rear side plate 33*c* of the main body part 33 and protrudes rearward.

As shown in FIG. 4, the drive unit 37 includes a motor 51, a mounting member 52 to which the motor 51 is mounted, an output shaft 53 supported by the mounting member 52 so as to be rotatable and a rotary variable resistor 54 which outputs an electric resistance value changed depending on a rotating angle of an input shaft.

The mounting member 52 is formed into a shallow box-like shape, and has a bottom plate and a circumferential wall stood from a circumferential edge of the bottom plate.

The motor 51 is supported by the bottom plate such that a motor shaft 51*a* extends in a direction along the bottom plate. A worm gear 56 is coaxially fixed to the motor shaft 51*a*.

The output shaft 53 penetrates through the bottom plate of the mounting member 52 and is rotatably supported by the bottom plate. An output gear 57 is coaxially fixed to a proximal end portion of the output shaft 53. Around a part of an outer circumferential face of the output gear 57, a fan-like shaped gear 58 is fixed on the same axis of the output gear 57. A tip end portion of the output shaft 53 is coaxially coupled to the rotating shaft 46 of the lift member 36 with a joint member 60. The joint member 60 couples the rotating shaft 46 and the output shaft 53 so that the rotating shaft 46 and the output shaft 53 are movable in approaching and separating directions within a predetermined range along the axis directions of the rotating shaft 46 and the output shaft 53 and also rotatable integrally.

Between the output gear 57 and the worm gear 56 fixed to the motor shaft 51*a*, first to third gear 61, 62, 63 are interposed. The first to third gears 61, 62, 63 are rotatably supported by shafts stood on the bottom plate. The first gear 61 has a large diameter part 61*a* and a small diameter part 61*b* which are coaxially provided. The large diameter part 61*a* has worm teeth capable of engaging with the worm gear 56 fixed to the motor shaft 51*a*. The second gear 62 has a large diameter part 62*a* and a small diameter part (not shown) which are coaxially provided. The large diameter part 62*a* is engaged with the small diameter part 61*b* of the first gear 61. The third gear 63 has a large diameter part 63*a* and a small diameter part 63*b* which are coaxially provided. The large diameter part 63*a* of the third gear 63 is engaged with the small diameter part of the second gear 62. The small diameter part 63*b* of the third gear 63 is engaged with the fan-like shaped gear 58 fixed to the output shaft 53.

Rotation of the motor shaft 51*a* is decelerated and transmitted to the output gear 57 via the first to third gear 61, 62 and 63 and, rotates the rotating shaft 46 of the lift member 36 together with the output shaft 53 in a predetermined direction.

The rotary variable resistor 54 is a member which outputs an electric resistance value proportional to a rotating angle of an input shaft 54*a*. To the input shaft 54*a*, a fan-like shaped input gear 65 is coaxially fixed. The rotary variable resistor 54 is supported on the bottom plate of the mounting member 52. The input gear 65 is engaged with the output gear 57. Thereby, rotation of the output gear 57 is amplified and transmitted to the input shaft 54*a* of the rotary variable resistor 54 via the input gear 65, and the rotary variable resistor 54 outputs an electric resistance value proportional to the rotating angle of the input gear 65, that is, the rotating angle of the output gear 57.

The sheet feeding mechanism 31 is provided at an right upper corner of the opening 2*a* (refer to FIG. 1) of the printer main body 2*a*, as shown in FIG. 2. The sheet feeding mechanism 31 includes a pickup roller 71 and a feed roller 72 which are arranged in the order from the upstream side in the sheet conveying direction, and a separating roller 73 disposed facing the feed roller 72.

The pickup roller 71 and the feed roller 72 are rotatably supported in a holder 74. The holder 74 is supported so as to be turnable in the vertical direction around a rotating axis of the feed roller 72. A position of the holder 74 is detected by a position sensor 75 (for example, PI sensor). The separating roller 73 is supported so as to be rotatable in the same direction (the counterclockwise direction in FIG. 2) as the rotating direction of the feed roller 72.

As shown in FIG. 5, the operation panel 27, the drive unit 37, the rotary variable resistor 54 and the position sensor 75 are electrically connected to the control part 77. The control part 67 includes a memory 68 which stores a data showing a relationship between the rotating angle of the drive shaft and an amount of sheets placed on the placing plate, and the others.

In the sheet feeding device 4 having the above described configuration, a detecting way of a remaining amount of sheets will be described. When the sheets are fully stored in the sheet feeding cassette 30, the placing plate 34 is not inclined and the sheets are stored in a horizontal posture. The pickup roller 71 comes into contact with the downstream side end portion of the uppermost sheet. When the pickup roller 71 and the feed roller 72 are rotated, the uppermost sheet is fed by the pickup roller 71, separated between the feed roller 72 and the separating roller 73 and then conveyed to the sheet conveying path 25.

When an amount of sheets placed on the placing plate 34 is decreased, the uppermost sheet is lowered in height. Then, the holder 74 turns in the counterclockwise direction in FIG. 2 and the pickup roller 71 is moved downward until it comes into contact with the uppermost sheet. When the position sensor 75 detects the pickup roller 71 which is moved downward to a predetermined height as the amount of sheets is decreased, a detecting signal is transmitted from the position sensor 75 to the control part 77. The control part 77 receives the detecting signal and then outputs a control signal to the drive unit 37 to turn the lift member 36. When the control signal is received, the drive unit 37 drives the motor 51 to rotate the rotating shaft 46. Thereby, the placing plate 34 is lifted by the lift member 36 and turned upward around the pins 41. Then, the sheets placed on the placing plate 34 moves the pickup roller 71 upward to turn the holder 74 in the clockwise direction in FIG. 2. When the position sensor 75 detects the holder 74 which is moved upward to a feeding position, a detecting signal is transmitted from the position sensor 75 to the control part 77. When the detecting signal is received, the control part 77 transmits a control signal for stopping the rotating of the rotating shaft 46 to the drive unit 37. Such a control makes it possible to always keep the feeding position constant within a predetermined range.

On the other hand, in the drive unit 37, the rotation of the rotating shaft 46 is amplified and transmitted to the input shaft 54*a* of the rotary variable resistor 54 via the output gear 57 and the input gear 65. Then, the rotary variable resistor 54 outputs an electric resistance value corresponding to a rotating angle of the input shaft 54*a*, and the electric resistance value is transmitted to the control part 77. The control part 77 calculates a rotating angle of the input shaft 54*a*, that is, a rotating angle of the rotating shaft 46 using the input electric resistance value output from the rotary variable resistor 54. In addition, based on the data stored in the memory 68 and showing the relationship between the rotating angle of the rotating shaft 46 and an amount of sheets placed on the placing plate 34, the control part 77 determines an amount of sheets from the calculated rotating angle. The determined amount of sheets is displayed on the operation panel 27 of the printer main body 2.

As described above, in the sheet feeding device 4 of the present invention, whenever the lift member 36 is turned, that is, whenever an inclining angle of the placing plate 34 is changed as an amount of sheets is changed, an amount of sheets in the sheet feeding cassette 30 is detected by the rotary variable resistor 54 and displayed on the operation panel 27. Thereby, it becomes possible to detect an amount of sheets at a number of steps. Accordingly, a more detail information for a remaining amount of sheets can be displayed.

Figure 6:
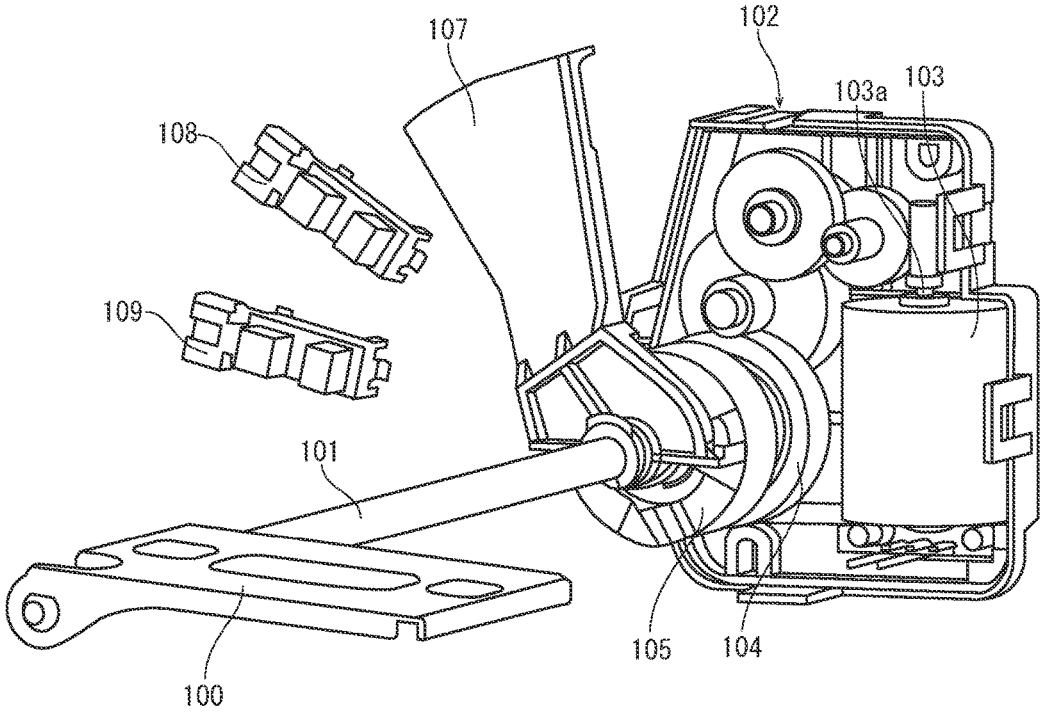
FIG. 6 is a perspective view showing a drive unit and a detecting mechanism of a remaining amount of sheets, in a conventional sheet feeding device.

In addition, the rotary variable resistor 54 has a configuration such that the electric resistance value linearly changes in proportion to the rotating angle so that a correct rotating angle can be obtained. Furthermore, the rotary variable resistor 54 and the input gear 65 coaxially fixed to the input shaft 54*a* of the rotary variable resistor 54 are mounted on the mounting member 52 of the drive unit 37 so that it becomes possible to make a mechanism for detecting an amount of sheets to be compact in size. Thereby, although the configuration described with reference to FIG. 6 requires to adjust the positions of the drive unit 102 and the sensors 108 and 109, the present disclosure makes it possible to mount the drive unit 37 easily without the adjustment of the positions.

In addition, the rotating shaft 46 of the lift member 36 and the output shaft 53 of the drive unit 37 are coupled through the joint member 60 so that the lift member 36 can be supported by the sheet feeding cassette 30. If the lift member 36 is provided separately from the sheet feeding cassette 30, it is required to form an opening for passing the lift member 36 on the bottom plate 33*a* of the main body part 33 of the sheet feeding cassette 30. In this case, foreign substance may enter through the opening. However, in a case where the lift member 36 is supported by the sheet feeding cassette 30, there is no need for forming such an opening on the bottom plate 33*a*. In this way, a freedom in design of the sheet feeding device 4 can be improved.

The embodiments of the present disclosure were described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a placing plate on which a sheet is placed;

a pickup roller which feeds the sheet to a conveying path;

a lift member which is turned around a rotating shaft to elevate the placing plate and to make an downstream side end portion of an uppermost sheet in a conveying direction come into contact with the pickup roller;

a fan-like shaped gear fixed on the same axis as the rotating shaft;

a drive unit which rotates the fan-like gear;

a variable resistor which changes an electric resistance value depending on a rotating angle of the rotating shaft;

a control part to which the variable resistor is connected, a memory storing a data showing a relationship between the rotating angle of the rotating shaft and an amount of the sheets placed on the placing plate; and an operation panel connected to the control part, wherein the control part calculates the rotating angle of the rotating shaft using the electric resistance value measured by the variable resistor, detects an amount of the sheets corresponding to the calculated rotating angle based on the data stored in the memory, and displays the detected amount of the sheets on the operation panel.

2. The image forming apparatus according to claim 1, wherein the electric resistance value is linearly changed in proportion to the rotating angle.

3. The image forming apparatus according to claim 1, comprising:

a holder which supports the pickup roller so as to be movable in a vertical direction; and a sensor which detects a height of the pickup roller, wherein the control part turns the lift member to elevate the placing plate when the height of the pickup roller detected by the sensor is lower than a predetermined height.

4. The image forming apparatus according to claim 1, comprising a sheet feeding cassette which supports the placing plate so as to be movable upward, wherein the lift member is disposed between a bottom plate of the sheet feeding cassette and a downstream side end portion of the placing plate in the conveying direction.

5. The image forming apparatus according to claim 1, wherein the drive unit includes:

a motor which generates rotating force;

an output shaft coupled to the rotating shaft;

an output gear provided to the output shaft;

a transmitting gear interposed between the motor and the output gear to transmit the rotating force to the output shaft; and a mounting member on which the motor, the output shaft and the transmitting gear are supported, the variable resistor includes;

an input shaft which changes an electric resistance value depending on its rotating angle; and an input gear provided to the input shaft and engaged with the output gear, the variable resistor is supported by the mounting member.

6. The image forming apparatus-according to claim 5, comprising a joint member which couples the rotating shaft and the output shaft such that the rotating shaft and the output shaft are movable within a predetermined range in axis directions of the rotating shaft and the output shaft in approaching and separating directions and also rotatable integrally.

7. The image forming apparatus according to claim 5, wherein the input gear amplifies and transmits rotation of the input shaft to the output gear.

* * * * *